US006196718B1

(12) United States Patent
DeChant

(10) Patent No.: US 6,196,718 B1
(45) **Date of Patent: *Mar. 6, 2001**

(54) MINIATURE GOLF BAG TRAVEL ORGANIZER

(76) Inventor: Daniel A. DeChant, 5434 Bremer Rd., McFarland, WI (US) 53558

( * ) Notice: Subject to any disclaimer, the term of this patent is extended or adjusted under 35 U.S.C. 154(b) by 0 days.

This patent is subject to a terminal disclaimer.

(21) Appl. No.: 09/474,646

(22) Filed: Dec. 29, 1999

Related U.S. Application Data

(63) Continuation of application No. 09/127,470, filed on Jul. 31, 1998, now Pat. No. 6,039,474.

(51) Int. Cl.[7] ..... B65D 33/25

(52) U.S. Cl. ..... 383/66; 383/23; 383/39; 383/98; 383/907; 190/109; 190/113; D3/255

(58) Field of Search ..... 383/66, 97, 4, 383/907, 23, 39, 98; 190/107, 109, 113, 903; D3/255

(56) References Cited

U.S. PATENT DOCUMENTS

| | | | | |
|---|---|---|---|---|
| D. 288,653 | | 3/1987 | Crymes . | |
| D. 323,242 | | 1/1992 | Costello . | |
| D. 324,975 | | 3/1992 | Miller . | |
| D. 327,422 | | 6/1992 | Laing . | |
| D. 328,688 | | 8/1992 | Palmer et al. . | |
| D. 330,631 | | 11/1992 | Ledbetter . | |
| D. 347,968 | | 6/1994 | Friedman . | |
| D. 348,567 | | 7/1994 | Dunn . | |
| D. 356,233 | | 3/1995 | Meier . | |
| D. 366,812 | | 2/1996 | Collins et al. . | |
| 2,165,665 | | 7/1939 | Thompson . | |
| 3,023,867 | * | 3/1962 | Kotkins | 190/903 X |
| 3,273,678 | * | 9/1966 | Koret | 190/109 |
| 3,465,993 | | 9/1969 | Muehlhausen . | |
| 3,777,862 | * | 12/1973 | Zipper | 190/903 X |
| 3,944,032 | * | 3/1976 | Samhammer et al. | 190/903 X |
| 3,994,372 | * | 11/1976 | Geller et al. | 190/107 |
| 4,210,186 | * | 7/1980 | Belenson | 190/113 X |
| 4,418,806 | | 12/1983 | Johnson . | |
| 4,746,159 | | 5/1988 | Webb et al. . | |
| 4,821,853 | | 4/1989 | Young . | |
| 5,025,928 | | 6/1991 | Orosy et al. . | |
| 5,095,924 | | 3/1992 | Stanfield . | |
| 5,265,719 | * | 11/1993 | Wand | 190/109 X |
| 5,425,449 | | 6/1995 | Boorady . | |
| 5,538,137 | * | 7/1996 | Deioma et al. | 190/109 X |
| 5,544,743 | | 8/1996 | Hong . | |
| 5,572,792 | | 11/1996 | Garabedian . | |
| 5,584,422 | * | 12/1996 | Bond-Madsen | 190/903 X |
| 5,651,455 | | 7/1997 | Garcia . | |
| 6,039,474 | * | 3/2000 | DeChant | 383/66 |

OTHER PUBLICATIONS

Menards Brochure, Jun. 1998.
SkyMall Catalog, Summer 1998.

* cited by examiner

*Primary Examiner*—Jes F. Pascua
(74) *Attorney, Agent, or Firm*—Michael Best & Friedrich LLP

(57) ABSTRACT

An organizer in the form of a miniature golf bag. The sidewall of the organizer is reclosable with a slide fastener which has a track that defines a bent U-shape. In an illustrated embodiment, the organizer can form a shelf-like portion when the organizer is in a hanging mode.

20 Claims, 6 Drawing Sheets

FIG. 1
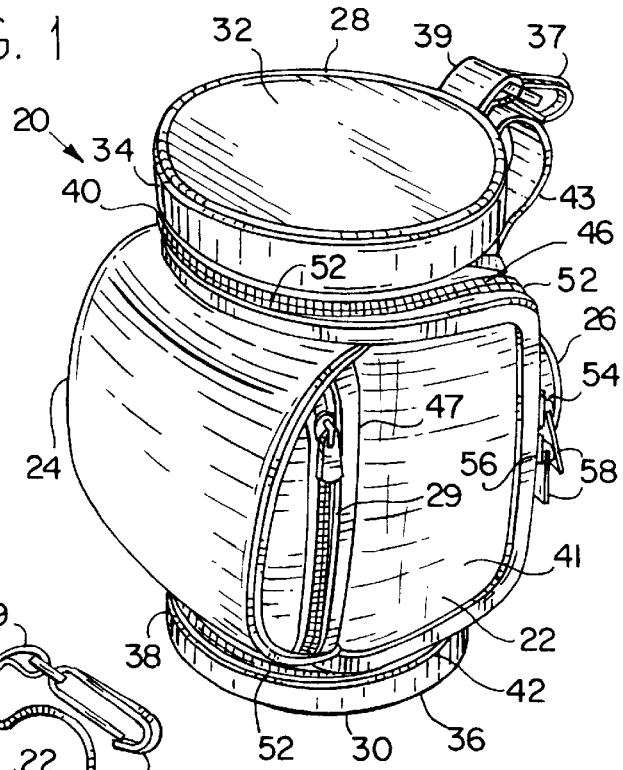
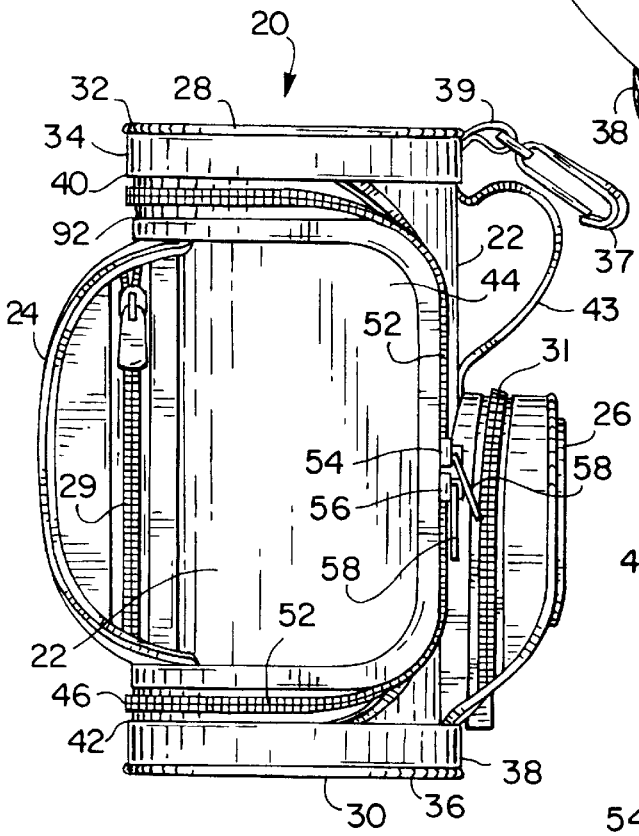
FIG. 2
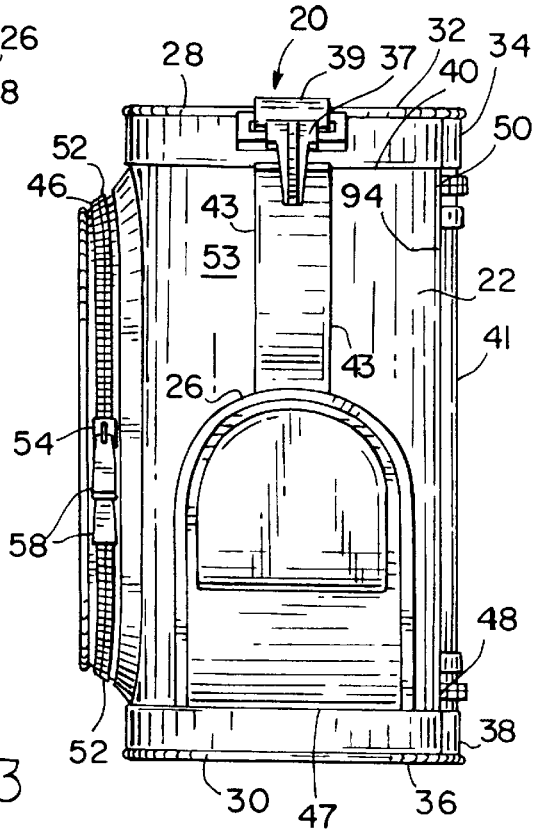
FIG. 3

FIG. 4
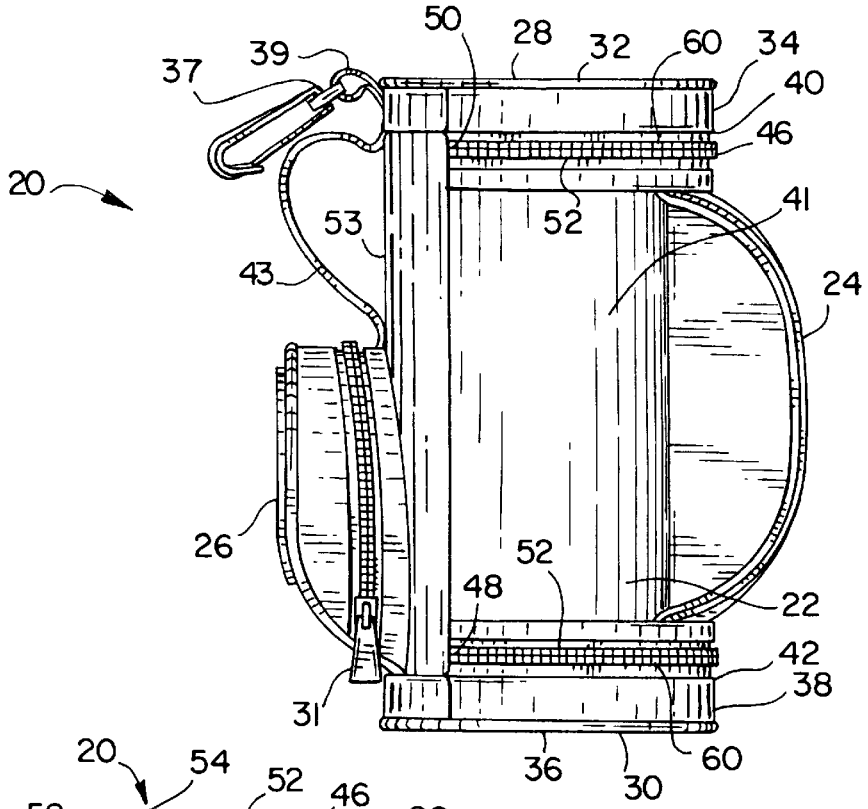
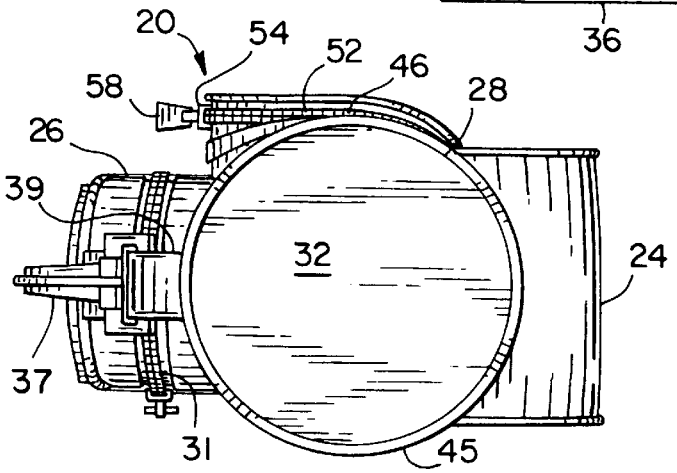
FIG. 5
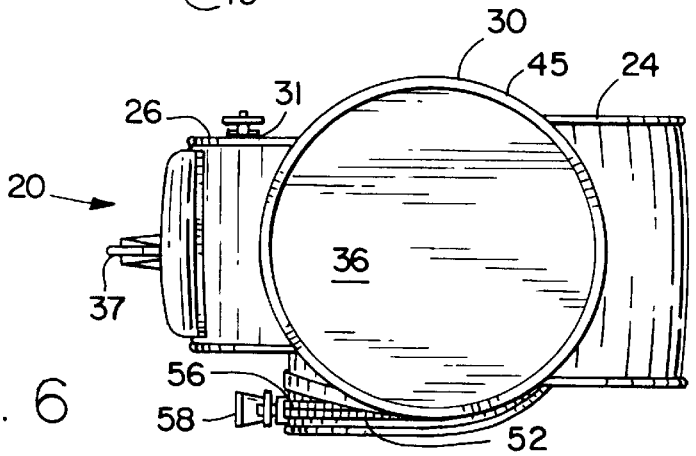
FIG. 6

FIG. 14
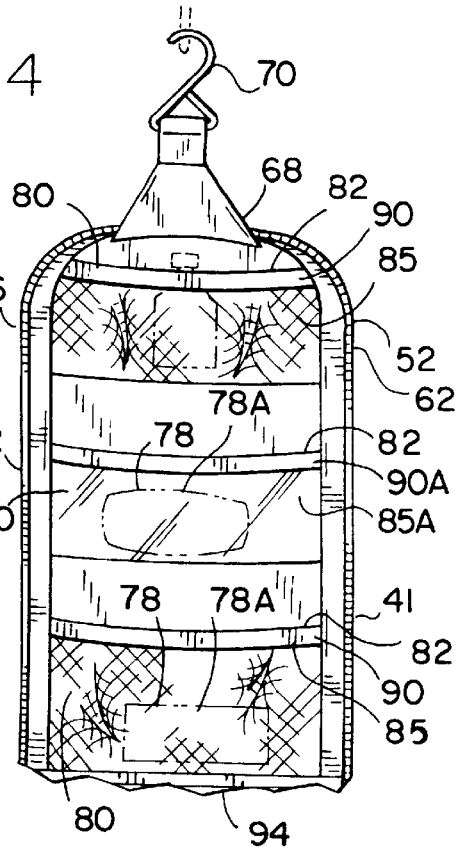
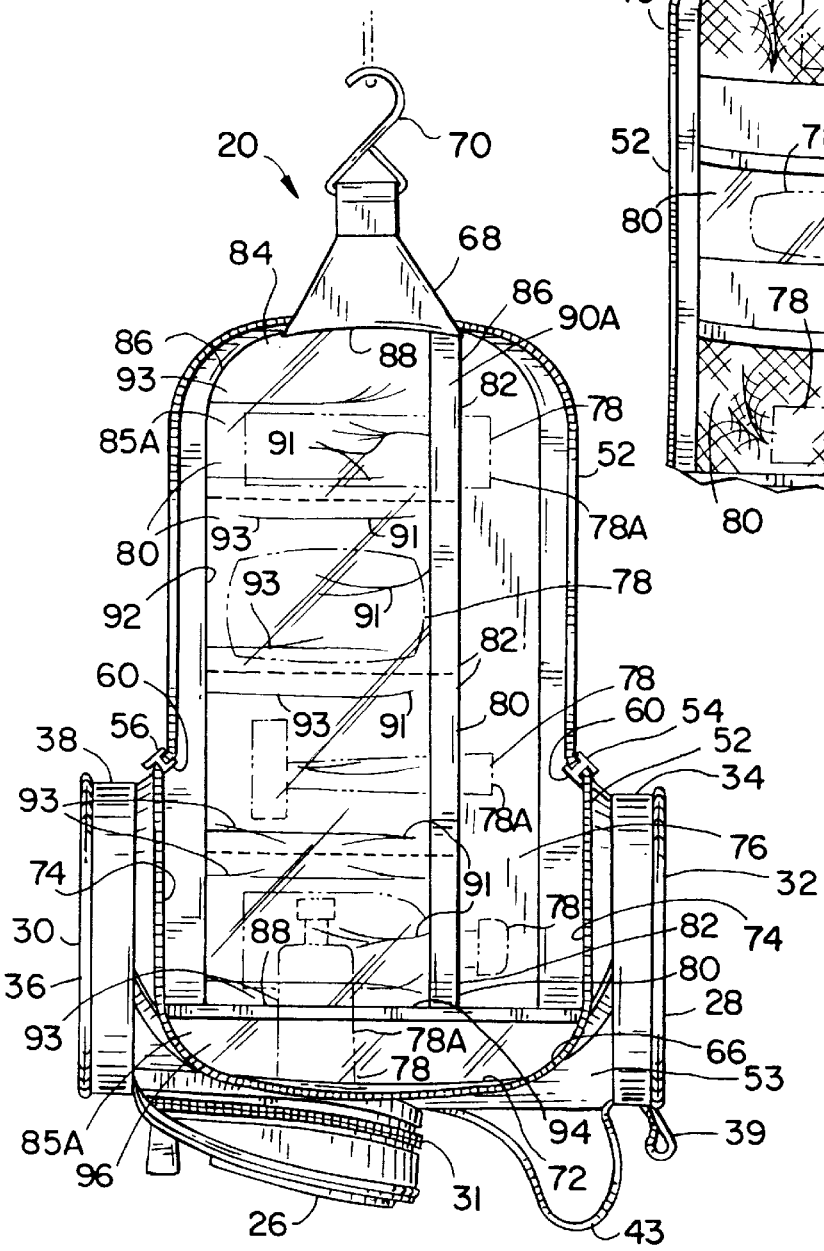
FIG. 13

MINIATURE GOLF BAG TRAVEL ORGANIZER

CROSS-REFERENCE TO RELATED APPLICATIONS

This application is a continuation of U.S. patent application No. 09/127,470 filed Jul. 31, 1998, now U.S. Pat. No. 6,039,474, which is incorporated herein by reference.

BACKGROUND OF THE INVENTION

This invention relates generally to a travel organizer or bag and in particular, to an organizer for holding utility items, which organizer is in the configuration of a miniature golf bag.

Over the years, travel kits, bags and the like for carrying utility items, such as, but not limited to, toiletry items have been very popular. A travel kit with an arrangement which allows easy access to the interior of the bag for ready insertion and extraction of various toiletry and other utility items is desirable.

Many arrangements have been proposed for providing a travel bag and like articles. Some bags provide one or more large compartments in which are held all the various items one might carry. Others have multiple compartments for arranging different items separately from each other. Examples of such travel bags are disclosed in, e.g., U.S. Pat. No. 4,821,853 to Young; U.S. Pat. No. 5,025,928 to Orosy et al.; U.S. Pat. No. 5,095,924 to Stanfield. Some travel or utility bag are capable of being hung from a hook, bar or the like. See, e.g., U.S. Pat. No. 5,651,455 to Garcia. While the hanging feature is convenient, such bags require that the items be kept in pockets or pouches so that they will not fall on the floor when the bag is hung. Bags are also known that are convertible into different functions; see, e.g., U.S. Pat. No. 5,425,449 to Boorady.

Despite these many variations, a need still exists for an improved utility or accessory organizer or bag for retaining and carrying small items of toiletry or the like.

BRIEF SUMMARY OF THE INVENTION

The present invention provides an organizer for holding utility items such as, but not limited to, toiletry items and the like wherein the organizer can be hung from a hook, bar or the like and forms a shelf-like structure for holding the items which can be loose in the same way that one places such items on an ordinary shelf, and wherein the organizer is in the shape of a miniature golf bag. In a preferred embodiment, the angle of the shelf-like portion is suitably changeable by a slide fastener which can be set in different positions.

The foregoing, and other advantages of the present invention, are realized in one aspect thereof in an organizer for holding utility items or the like, which comprises a miniature golf bag sized to enclose and hold the items. The bag includes a main inner recloseable storage compartment, the main inner compartment being substantially tubular and having substantially flat opposed ends, a recloseable sidewall therebetween and having a circumference, and a slide fastener. The slide fastener has a first terminus proximate one end and a second terminus proximate the other opposed end, the second terminus being substantially rectilinearly spaced apart from the first terminus. The slide fastener extends from the first terminus in a direction substantially paralleling one end to a distance approximately ¾ of the circumference, curves and then extends substantially rectilinearly toward the other end, and then curves toward the second terminus and extends in a direction substantially paralleling the other end to the second terminus.

In another aspect, the present invention provides an organizer for holding utility items which comprises a miniature golf bag sized to enclose and carry the utility items. The bag has a tubular main body portion having opposed closed ends, a reclosable sidewall defining a main body storage compartment, and a slide fastener. The slide fastener has a first terminus, a second terminus, and a track extending between the first and the second terminus. A pair of self-locking slides is mounted on the track. Each of the pair of self-locking slides is associated with one of the two termini, and each slide has a pull tab. The slide fastener is incorporated into the tubular main body portion to define the reclosable sidewall, and the pair of self-locking slides of the slide fastener can be manipulated to partially open the reclosable sidewall to define a rectangular flap and a shelf-like portion.

Other advantages and a fuller appreciation of the specific attributes of this invention will be gained upon an examination of the following drawings, detailed description of preferred embodiments, and appended claims. It is expressly understood that the drawings are for the purpose of illustration and description only, and are not intended as a definition of the limits of the invention.

BRIEF DESCRIPTION OF THE DRAWING(S)

The preferred exemplary embodiment of the present invention will hereinafter be described in conjunction with the appended drawing wherein like designations refer to like elements throughout and in which:

FIG. 1 is a perspective view of the preferred embodiment of the present invention;

FIG. 2 is a right side view thereof;

FIG. 3 is a front view thereof;

FIG. 4 is a left side view thereof;

FIG. 5 is a top view thereof;

FIG. 6 is a bottom view thereof;

Figure 7:
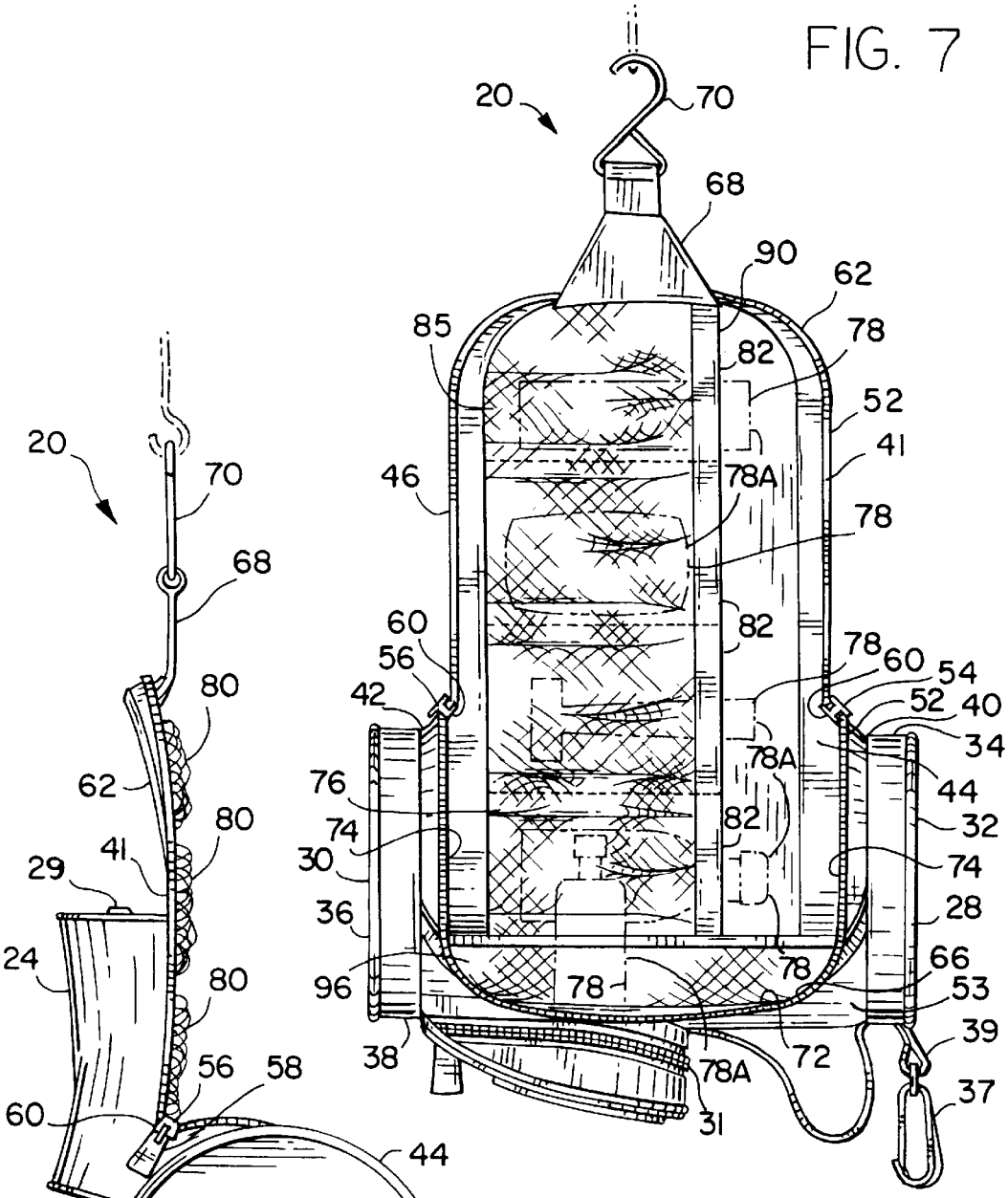
FIG. 7 is a front view of the preferred embodiment of the present invention in the hanging mode, illustrating the shelf-like portion which is formed with a utility item shown in phantom resting on the shelf-like portion.
Figure 9:
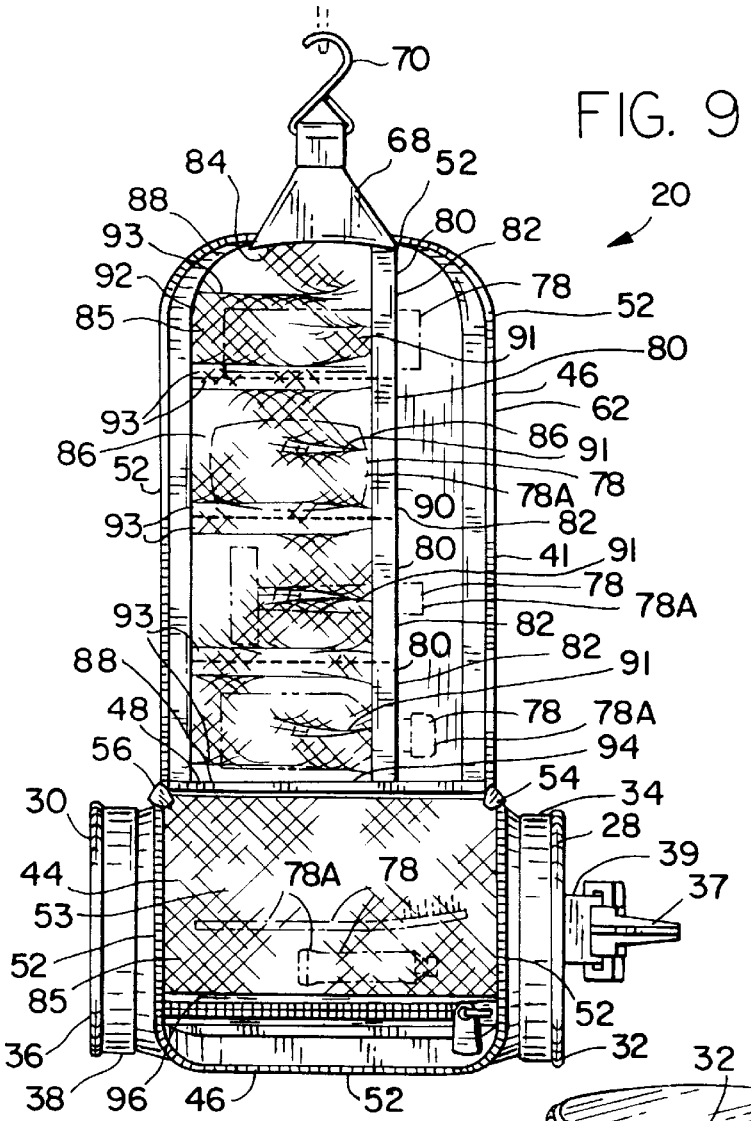
FIG. 9 is a front view of the present invention in the hanging mode with each zipper slide at its respective terminus, illustrating the flap in its fully extended position and the main body storage compartment, with utility items shown in phantom.
Figure 11:
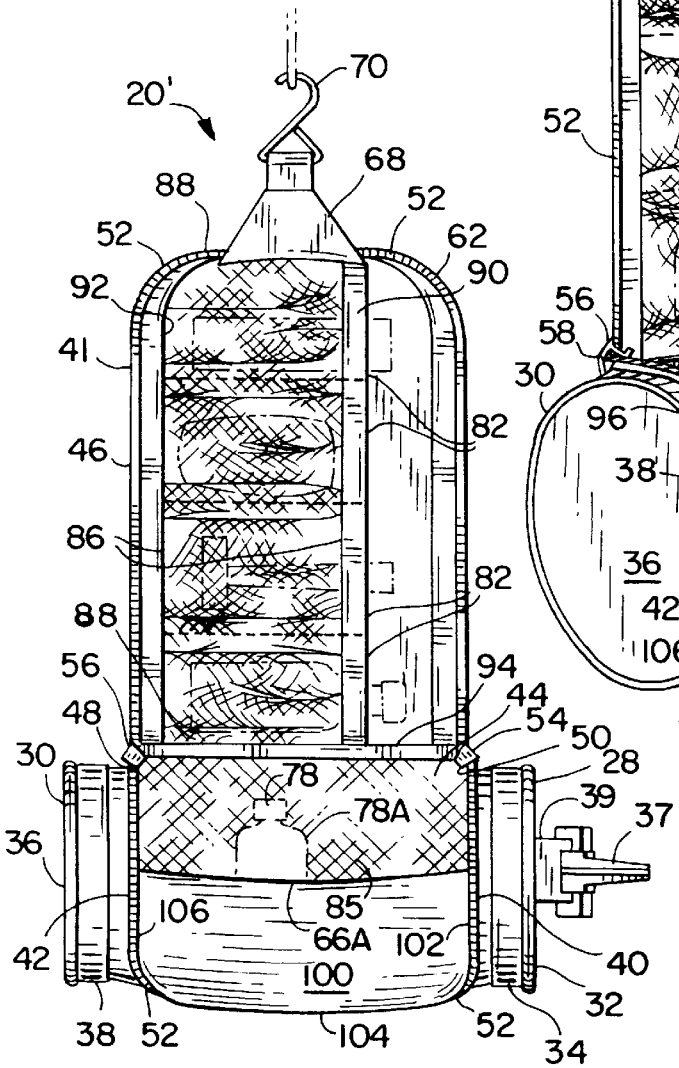
Figure 12:
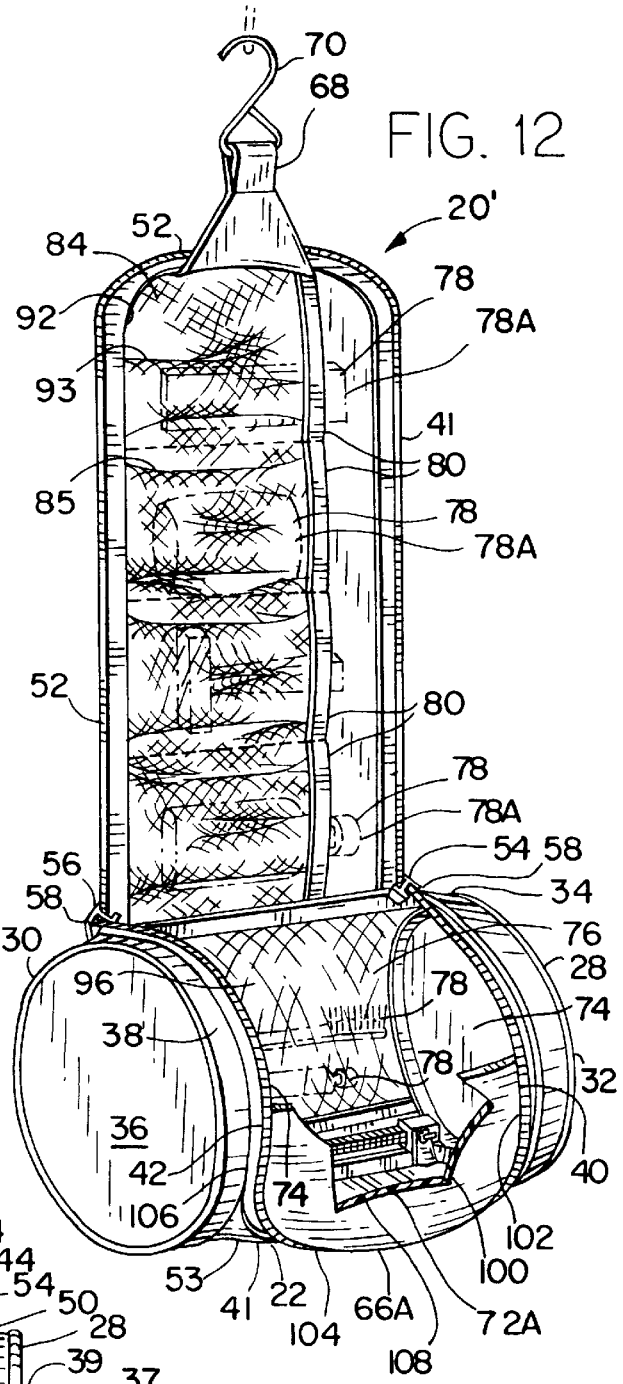

FIG. 11 is a front view of a second embodiment of the present invention having a "U" shaped sidewall portion therein, illustrating the invention in the hanging mode with each zipper slide at its respective terminus, the flap in its fully extended position and the main body storage compartment, and the shelf-like portion which is formed by the "U" shaped sidewall portion with a utility item shown in phantom resting on the shelf-like portion;

FIG. 12 is a perspective view of FIG. 11 with the "U" shaped sidewall portion partially cutaway to show the shelf-like portion and without a utility item resting on the shelf-like portion;

FIG. 13 is a front view of the present invention as shown in FIG. 7, using a nonperforate material for the pockets, using a nonelastic material along one of the long edges of the pockets and without the exterior fastening assembly; and FIG. 14 is a partial front view of the flap 62 shown in FIG. 9, illustrating another orientation of the pockets of the present invention.

DETAILED DESCRIPTION OF THE INVENTION

The present invention relates broadly to travel bags, toiletry bags and the like, and provides an organizer for holding utility items in the configuration of a miniature golf bag. In an illustrated embodiment, the present invention is characterized by an ability to be hung from a hook, bar or the like and form a shelf-like portion for holding articles and items. These attributes are achieved through a novel combination of physical features.

Reference is initially made to FIGS. 1–10 and 13 depicting a preferred first embodiment of an organizer, specifically an organizer for holding utility items, and designated generally by reference numeral 20. Organizer 20 is in the configuration of a miniature golf bag according to the present invention. Organizer 20 includes a main body portion 22, a first exterior storage compartment 24, a second exterior storage compartment 26, a top 28 and a bottom 30. The first exterior storage compartment 24 and the second exterior storage compartment 26 are each recloseable, each preferably with a slide fastener, e.g., a zipper, 29 and 31, respectively.

Top 28 of the organizer 20 has a substantially flat top portion 32 and a sidewall 34. Bottom 30 has a substantially flat bottom portion 36 and a sidewall 38. Sidewall 34 has a lower rim 40, and the sidewall 38 has an upper rim 42. Extending from the lower rim 40 to the second exterior storage compartment 24 is an exterior carrying strap 43. Extending from the flat top portion 32 adjacent the exterior carrying strap 43 is an exterior fastener assembly strap 39 having an exterior fastener assembly 37, most preferably in the form of a fastening clip. Alternatively, the exterior fastener assembly 37 may be absent as shown in FIG. 13.

Main body portion 22 has a generally tubular shape with a sidewall 41 and defines a main body storage compartment 44 having a circumference 45. Main body storage compartment 44 is reclosable with a slide fastener, e.g., a zipper 46. As best shown in FIG. 4, zipper 46 has one terminus 48 (hereinthroughout, a first terminus) proximate bottom 30 and the second storage compartment 26 and another terminus 50 (hereinthroughout, a second terminus) spaced apart and directly above terminus 48 and proximate top 28. As best shown in FIGS. 1, 2, 4 and 9, zipper 46 extends from terminus 50 approximately ¾ way around rim 40 of top 28, then curves downward, extending toward rim 42. Zipper 46 then curves toward terminus 48, and extends approximately ¾ way around rim 42 to terminus 48 defining a zipper track 52. When zipper 46 is fully zipped, track 52 has a bent U-shape; i.e., a "U" bent upon itself; essentially a U-shaped "U." As best shown in FIG. 3, a remaining sidewall 53, i.e., a non-zippered body portion, occupies the remaining area of sidewall 41, i.e., it is disposed approximately the remaining ¼ way around the rim 40 of top 28 and approximately the remaining ¼ way around the rim 42 of bottom 30.

Figure 8:
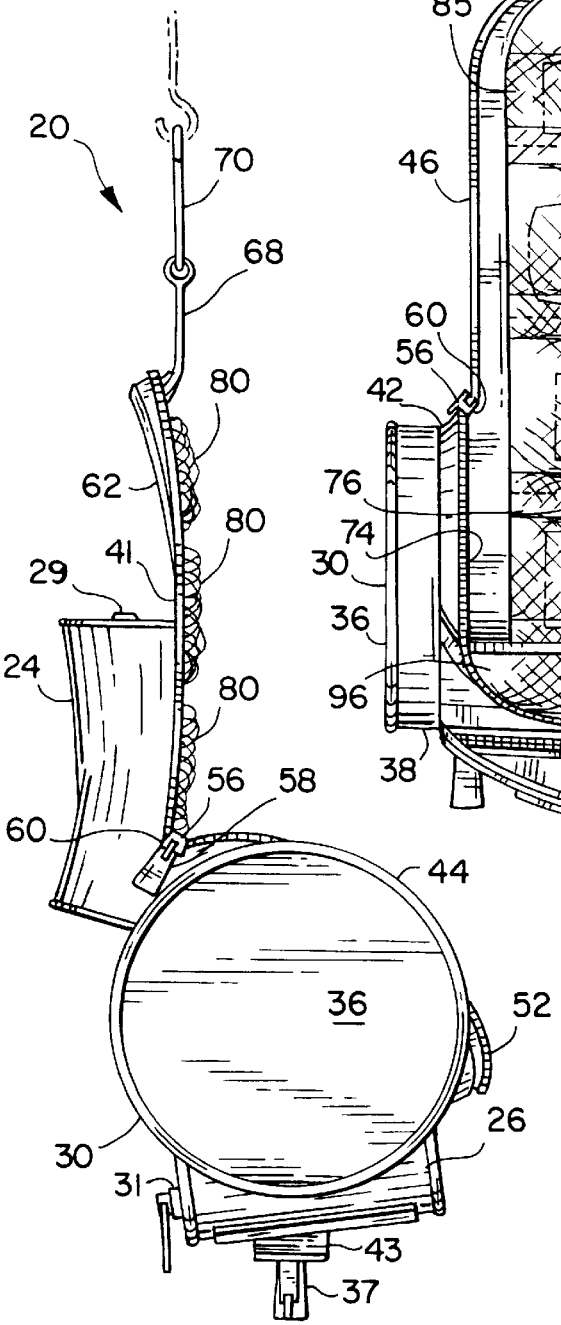
FIG. 8 is a side view of the hanging mode illustrated in FIG. 7.

Zipper 46 has two slides 54 and 56, respectively, each with a pull tab 58. Slides 54, 56 are mounted on the zipper track 52. Slides 54 and 56 are preferably self-locking such that their positions are held at any point in the zipper track 52. Alternatively, slides 54, 56 need not be self-locking. As seen in FIGS. 7 and 8, when slides 54 and 56 are self-locking and each start at a respective terminus and close the zipper 46 at a pair of points 60 about ⅓ the distance around the rims 40 and 42, respectively, sidewall 41 is opened to define a generally rectangular flap 62, exposing the compartment 44. In doing so, top 28, bottom 30 and remaining sidewall portion 53 define a shelf-like portion 66. Rectangular flap 62 has a strap 68 to which a hook 70 is attached.

Shelf-like portion 66 suitably has a shelf base 72, a pair of opposing shelf sides 74 and a shelf back 76. As best shown in FIGS. 7 and 8, shelf base 72 is formed by the remaining sidewall 53. The pair of opposing shelf sides 74 are formed by top 28 and bottom 30 of the organizer 20. Shelf back 76 is formed by flap 62. The angle of shelf-like portion 66 is suitably changeable by slides 54, 56 which can be set in different positions on zipper track 52. When this occurs, shelf base 72 is formed by portions of remaining sidewall 53 and/or portions of flap 62.

In the present invention, a utility item 78, such as, but not limited to, a calculator, a hand held electronic game, a small radio or television, a watch, jewelry, a container of medication, candy, gum, a necktie, a scarf, a wallet, a coin purse, hair fasteners, etc., or a utility item 78, such as a toiletry item 78A, e.g., such as, but not limited to, a soap, a razor, a container of hand lotion, shampoo, or conditioner, a container of swabs, a toothbrush, a tube of tooth paste, a container of mouth wash, a deodorant, a sewing kit, a comb, a brush, a container of bandages, a container of ointment, etc., need not be kept in pockets or pouches because it will not fall on the floor when organizer 20 is hung using the hook 70, e.g., in the hanging mode. As best shown in FIG. 7, when organizer 20 is in the hanging mode, utility item 78 can be placed on the shelf base 72. Most advantageously, utility items 78 or other articles can be loose in the same way that one places such items or articles on an ordinary shelf.

As best shown in FIG. 9, when slides 54, 56 are positioned at a respective terminus 50, 48, flap 62 is in a fully extended position exposing main body storage compartment 44. Flap 62 has a plurality of storage pockets 80 thereon, allowing for the organization of various utility items 78 or other articles, therein. Flap 62 in its fully extended position has a flap width and a flap length. Each storage pocket 80 of the plurality of storage pockets has a pocket opening 82 through which the utility item may be inserted.

The plurality of storage pockets 80 are preferably formed of a generally rectangular sheet 84 of preferably a flexible perforate material 85, such as a sheet of nylon or polyester mesh, most preferably having a plurality of mesh holes, each mesh hole approximately 3 mm in diameter. Generally, rectangular sheet 84 has two opposite long edges 86 and two opposite short edges 88. Long edges 86 of the sheet 84 are dimensioned to slightly exceed the flap length. Short edges 88 of the sheet 84 are dimensioned to be less than the flap width. Preferably, one of long edges 86 of sheet 84 is bound in an elastic material 90 which is slightly stretched; this bound long edge forms the pocket opening 82. Elastic material 90 in the relaxed state is dimensioned to approximate the flap length. When elastic material 90 is relaxed, perforate material 85 of sheet 84 along elastic material 90 forms puckers 91 since it exceeds the flap length. The other long edge 86 of sheet 84 and one of the short edges 88 are preferably incorporated in a seam 92 which sews zipper 46 to the flap 62. Perforate material 85 is suitably pleated to form pleats 93 along the other long edge, e.g., the nonelastic bound edge, to fit the flap length. Other short edge 88 is incorporated into a seam 94 extending between the pair of terminus 48, 50 of zipper 46.

The plurality of pockets 80 are created by sewing elastic material 90 and perforate material 85 to flap 62 at varying locations. Suitable placement of the pleats 93 assists in creating making the pockets 80, expandable to accommodate a wide variety of utility items 78. Each of the pockets 80 runs parallel to the flap width, i.e., short sides of the flap 62, with the pocket openings 82 running parallel to the flap length. A respective utility item 78 is inserted horizontally into pocket opening 82 of pocket 80 when organizer 20 is in the hanging mode. Elastic material 90 suitably compresses against the utility item 78, thereby preventing slippage of the item when organizer 20 is carried or hung.

Another storage pocket 96 is provided within organizer 20 and also, preferably made of the perforate material 85. As best shown in FIG. 9, preferably this pocket is a zippered pocket and is disposed in the remaining side wall 53.

Figure 10:
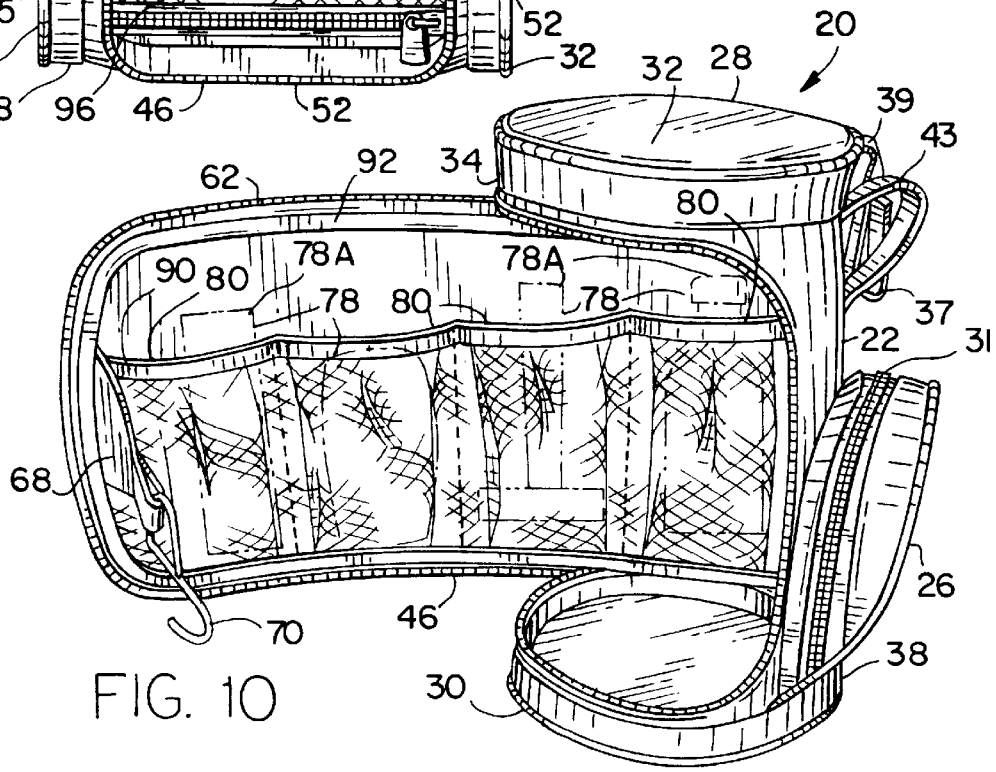
FIG. 10 is a perspective view of the present invention shown open and resting on a surface, with utility items shown in phantom.

As best shown in FIG. 10, when organizer 20 is set upright on a surface, pockets 80 are oriented so that elastic material 90 is oriented toward the top 28 of organizer 20.

Alternatively, the pockets 80 and storage pocket 96 may be formed of a nonperforate material 85A, such as a transparent material or sheer material, such as, but not limited to, a transparent plastic material or a sheer cotton, polyester or polyester blend fabric, in the aforementioned manner.

In a further alternate embodiment, the elastic material 90 may be omitted and instead a nonelastic material 90A may be used to bind one of long edges 86 of the sheet 84 to form pocket opening 82. The nonelastic material 90A is dimensioned to approximate the flap length. The nonelastic material 90A is suitably used with either the perforate material 85 or nonperforate material 85A, and one of the long edges 86 of the materials 85 or 85A are either pleated or gathered and bound, e.g., sewn, glued or otherwise fastened to the nonelastic material 90A. The other long edge 86, and the short edges 88 are treated as previously described herein. The plurality of pockets 80 are created by sewing the nonelastic material 90A and either the perforate material 85 or the nonperforate material 85A to flap 62 at varying locations. The nonelastic material 90A is a material such as, but not limited to, a cotton, polyester, cotton blend, polyester blend, nylon, or PVC plastic fabric.

FIG. 13 best illustrates the organizer 20 of the present invention showing the pockets 80, 96 made of a nonperforate material 85A, most preferably a transparent plastic material, and showing the use of an nonelastic material 90A, e.g., a PVC plastic fabric.

In yet another alternate embodiment, the pockets 80 of the organizer 20 of the present invention may be oriented so pocket opening 82 runs parallel to the flap width of flap 62, as best shown in FIG. 14. In this pocket orientation, the pockets 80 may be made of a perforate material 85 or a nonperforate material 85A; pocket opening 82 may be made of an elastic material 90 or a nonelastic material 90A.

FIGS. 11 and 12 show a second embodiment of the organizer 20 of the present invention. The second embodiment, organizer 20' is constructed identically to that of the preferred embodiment, organizer 20, herein before disclosed and shown in FIGS. 1–10 and 13–14 which disclosure is herein incorporated by reference for organizer 20'. Like numbering is used for identical elements of the invention.

Organizer 20' has the same exterior appearance as organizer 20, as shown in FIGS. 1–6. As best shown in FIGS. 11 and 12, organizer 20' differs from organizer 20 by the incorporation of a "U" shaped sidewall portion 100. The "U" shaped sidewall portion 100 is fastened to a portion 102 of lower rim 40 of side wall 34 of top portion 32, to a portion 104 of remaining sidewall 53 and to a portion 106 of upper rim 42 of sidewall 38 of bottom 30. Portions 102 and 104 extend about ¼ to ⅓ the distance around the rims 40, 42. As best shown in FIG. 11, when organizer 20' is in the hanging mode with each zipper slide 54, 56 at its respective terminus 50, 48, and with the flap 62 in its fully extended position exposing the main body storage compartment 44, a shelf-like portion 66A is formed by the "U" shaped sidewall portion 100, top 28 and bottom 30. A utility item 78 is shown in phantom line resting on the shelf-like portion 66A.

Shelf-like portion 66A suitably has a shelf base 72A, a pair of opposing shelf sides 74 and a shelf back 76. As best shown in FIGS. 11 and 12, shelf base 72A is formed by a part 108 of the "U" shaped sidewall portion 100 fastened to portion 104 of the remaining sidewall 53. The pair of opposing shelf sides 74 are formed by top 28 and bottom 30 of the organizer 20. Shelf back 76 is formed by storage pocket 96.

FIG. 12 is a perspective view of FIG. 11 with the "U" shaped sidewall portion 100 partially cutaway to show the shelf-like portion 66A and without a utility item 78 resting on the shelf-like portion 66A.

Organizers 20, 20' are suitably sized to enclose and carry utility items 78 within the pockets 80, 96. Preferably, organizer 20, 20' in the shape of a miniature golf bag has a length from top 28 to bottom 30 of approximately 9 inches and a width across the top 28 or bottom 30 of approximately 5.25 inches. Organizer 20, 20' is suitably made of polyester fabric, nylon fabric or PVC fabric, and can have a waterproof backing, most preferably a ripstock fabric. The waterproof backing faces the main body storage compartment 44. The "U" shaped sidewall portion 100 is suitably made of a fabric, such as but not limited to, cotton fabric, cotton blend fabric, polyester fabric, polyester blend fabric, nylon fabric or PVC fabric, preferably with a waterproof backing, most preferably a ripstock fabric.

When organizer 20, 20' is filly closed, i.e., fully zippered, the attractiveness of the miniature golf bag configuration and the easy portability thereof are highly appreciated.

While the present invention has now been described and exemplified with some specificity, those skilled in the art will appreciate the various modifications, including variations, additions, and omissions, that may be made in what has been described. Accordingly, it is intended that these modifications also be encompassed by the present invention and that the scope of the present invention be limited solely by the broadest interpretation that lawfully can be accorded the appended claims.

What is claimed is:

1. An organizer for holding utility items comprising:

a miniature golf bag sized to enclose and carry the utility items, the bag having a tubular main body portion having opposed closed ends, and a reclosable sidewall defining a main body storage compartment, and a slide fastener having a first terminus and a second terminus, a single slide fastener track extending between the first and the second terminus, a pair of slides mounted on the track, one of each of the pair of slides associated with one of the two termini, and a pair of pull tabs, one of each of the pair of pull tabs associated with one of the pair of slides;

wherein the slide fastener is incorporated into the tubular main body portion to define the reclosable sidewall, and wherein the pair of slides of the slide fastener are manipulated to partially open the reclosable sidewall, defining a rectangular flap and a shelf-like portion.

2. The organizer of claim 1, wherein the first terminus, proximate one of the closed ends, and the second terminus, proximate the opposed end, are spaced apart from one another on the sidewall, and the track extends from the first terminus partially around the tubular main body portion, then curves and extends toward the opposed end, then curves toward the second terminus and extends partially around the tubular main body portion to the second terminus; a remaining sidewall portion formed by a remaining portion around the tubular main body.

3. The organizer of claim 1, wherein the slides are each positioned at their respective associated termini and advanced partially around the tubular main body portion, exposing the main body storage compartment and the shelf-like portion.

4. The organizer of claim 1, further comprising an exterior storage compartment proximate the first terminus.

5. The organizer of claim 1, further comprising a plurality of pockets disposed on the flap of the main body storage compartment.

6. The organizer of claim 1, further comprising a hook disposed on the flap.

7. An organizer for holding utility items comprising:

a miniature golf bag sized to enclose and carry the utility items, the bag having a tubular main body portion having opposed ends and a reclosable sidewall defining a main body storage compartment, and a top and a bottom disposed at the opposed ends, the top having a lower rim and the bottom having an upper rim, and a slide fastener disposed in the sidewall, the slide fastener having a first terminus and a second terminus, a single zipper track, extending between the first and the second terminus, and defining a bent U-shape, a pair of slides mounted on the track, one of each of the pair of slides associated with one of the two termini; and a pair of pull tabs, one of each of the pair of pull tabs associated with one of the pair of slides;

the first terminus disposed proximate the bottom on the upper rim and the second terminus disposed proximate the top on the lower rim, with the second terminus spaced apart and directly above the first terminus;

the track extending from the first terminus partially around the upper rim, then curving toward the top and extending to the lower rim, then curving toward the second terminus and extending partially around the lower rim to the second terminus, a remaining sidewall portion formed by a remaining portion around the tubular main body.

8. The organizer of claim 7, wherein the pair of slides of the slide fastener are manipulable to partially open the reclosable sidewall, thereby defining a rectangular flap which defines a shelf-like portion.

9. The organizer of claim 8, wherein the slides are each positioned at a respective termini and then advanced partially around the upper rim and around the lower rim, exposing the compartment and the shelf-like portion.

10. The organizer of claim 8, wherein the shelf-like portion is formed by the top, the bottom, the flap and the remaining sidewall portion.

11. The organizer of claim 7, further comprising a plurality of storage pockets disposed on the flap and oriented into the main body storage compartment.

12. The organizer of claim 7, further comprising a storage pocket disposed on the remaining sidewall portion and oriented into the main body compartment.

13. The organizer of claim 7, further comprising a hook disposed on the flap.

14. The organizer of claim 7, further comprising a "U" shaped sidewall portion disposed between both ends and the remaining sidewall portion.

15. The organizer of claim 14, wherein the pair of slides of the slide fastener are manipulable to the first and second terminus to filly open the recloseable sidewall and define a rectangular flap and a shelf-like portion.

16. The organizer of claim 7, further comprising first and second exterior storage compartments disposed on the tubular body main portion, the second compartment being disposed substantially opposite the first compartment.

17. The organizer of claim 16, wherein the first terminus is proximate the second exterior storage compartment.

18. An organizer for holding utility items, comprising:

a miniature golf bag sized to enclose and hold the items, the bag including a main inner reclosable storage compartment, the main inner compartment being substantially tubular and having substantially flat opposed ends, a reclosable sidewall therebetween and having a circumference, and a slide fastener having a first terminus proximate one end and a second terminus proximate the other opposed end, the second terminus being substantially rectilinearly spaced apart from the first terminus, the slide fastener including a single slide fastener track extending between the first and the second terminus, the slide fastener further including a slide which is movable on the track between the first terminus in a direction substantially paralleling one end, curving and then extending substantially rectilinearly toward the other end, and then curving toward the second terminus and then being movable in a direction substantially paralleling the other end.

19. The organizer of claim 18, further comprising a first exterior reclosable compartment and a second exterior recloseable compartment.

20. The organizer of claim 18, wherein the slide fastener includes a second slide, wherein the slides are a pair of self-locking slides such that when one of the pair is manipulated from the first terminus and the other of the pair from the second terminus, partially closing the slide fastener from the first terminus and the second terminus a shelf-like portion and a flap are defined.

* * * * *